US005424931A

United States Patent [19]

Wheeler

[11] Patent Number: 5,424,931

[45] Date of Patent: Jun. 13, 1995

[54] MOBILE ILLUMINATION DEVICE

[76] Inventor: Todd D. Wheeler, 8726 S. 1645 East, Sandy, Utah 84092

[21] Appl. No.: 239,717

[22] Filed: May 9, 1994

[51] Int. Cl.[6] ..... F21S 1/12

[52] U.S. Cl. ..... 362/418; 362/270; 362/250; 362/419; 362/427

[58] Field of Search ..... 362/418, 270, 419, 427, 362/250, 236

[56] References Cited

U.S. PATENT DOCUMENTS 1,397,453 11/1921 Rekar ..... 362/270
1,813,383 7/1931 Chesney et al. ..... 362/270
2,267,653 12/1941 Hawkins ..... 362/413
2,352,496 6/1944 Rose ..... 362/427
3,535,509 10/1970 Thornton ..... 362/413
4,803,606 2/1989 Rotter ..... 362/253
5,126,928 6/1992 Hughes ..... 362/419

*Primary Examiner*—Ira S. Lazarus
*Assistant Examiner*—L. Heyman
*Attorney, Agent, or Firm*—Michael I. Kroll

[57] ABSTRACT

A mobile illuminating device comprising an adjustable base. Elements are for providing mobility to the base. An adjustable stanchion is on the base. An adjustable elongated arm is on the stanchion, so as to overhang the base. An adjustable light source is on the arm.

4 Claims, 4 Drawing Sheets

40
50
50
44
48
42
12
64
68
62
36
20
38
48
22
42
5
32
4
34
18
70
30
28
66
24
26
16
9
42
20
64
58
56
52
62
54
60
42
22
18
3
8
8
14

58
30
18
12
56
52
32
14
60
24
54

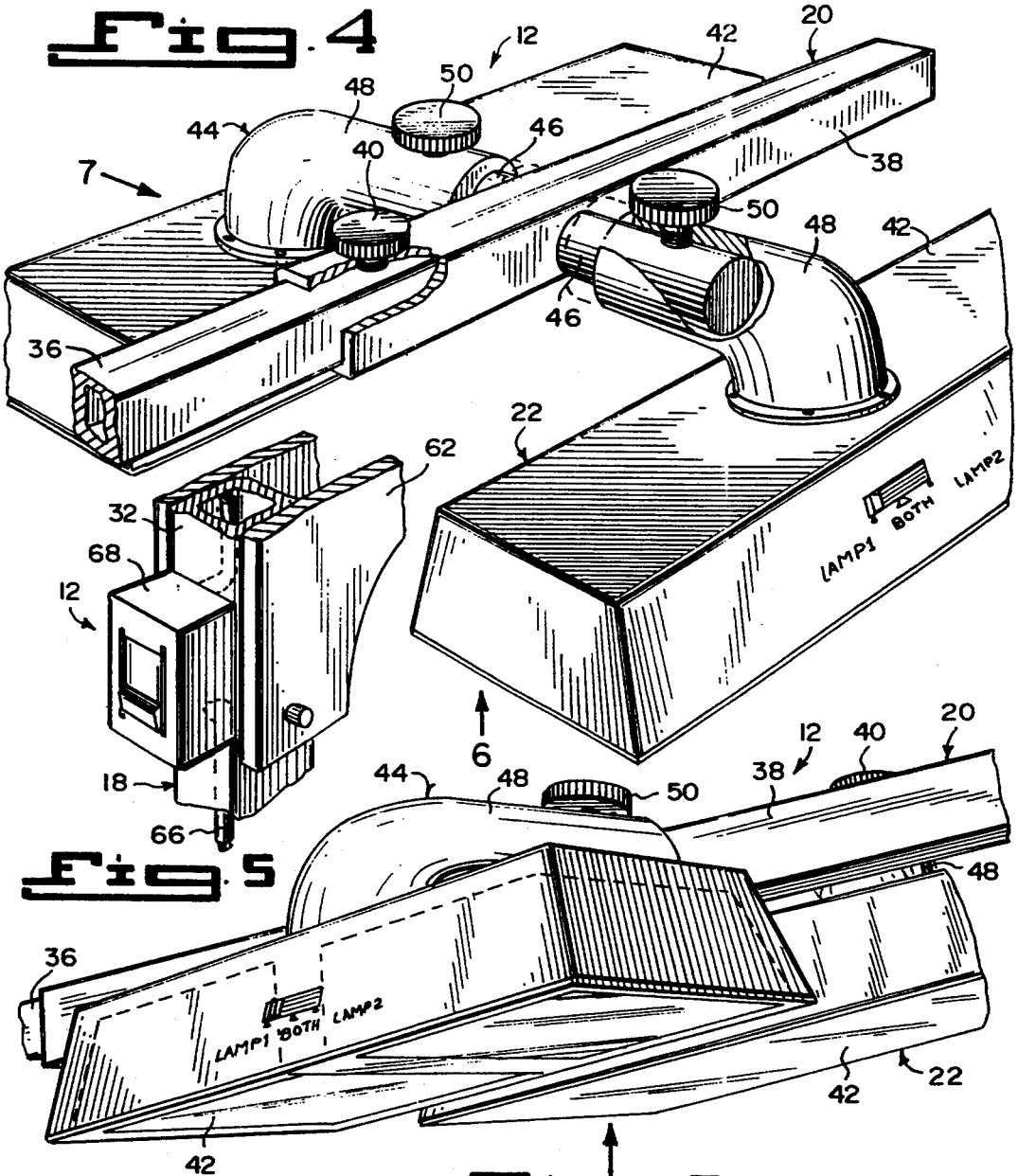
Fig. 4
Fig. 5
Fig. 6
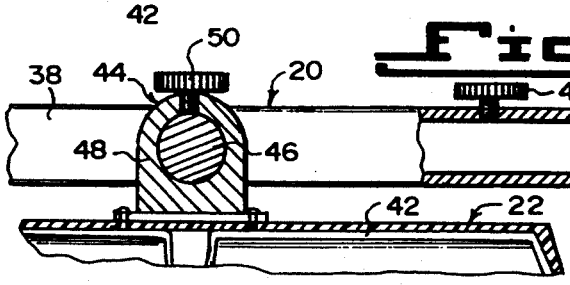
Fig. 7

30
12
18
54
30
20
58
56
60
12
38
52
14
18
24
30
60
54

24
58
56
14
52
12
62
20
42
22
64
36
44
38
28
68
40
48
50
32
34
18
70
66
30
24
14
26
56
52
54
16
58
60

MOBILE ILLUMINATION DEVICE

BACKGROUND OF THE INVENTION

1. Field of the Invention

The instant invention relates generally to portable light units and more specifically it relates to a mobile illumination device.

2. Description of the Prior Art

Numerous portable light units have been provided in prior art. For example U.S. Pat. Nos. 3,670,156 to Schmidt; 4,803,606 to Rotter; 4,935,854 to Kernodle and 5,203,621 to Weinmeister et al. all are illustrative of such prior art. While these units may be suitable for the particular purpose to which they address, they would not be as suitable for the purposes of the present invention as heretofore described.

A heavy castor mounted work stand cabinet forms the support base for a fixed vertical stanchion extending up a backside of the stand. The stanchion pivotally supports, at its top end, an elongated arm which extends outwardly above and past the front face of the work stand. Adjustable means are provided for supporting the arm either at right angles to the stanchion or at an obtuse angle with respect thereto. Pairs of parallel, spaced apart fluorescent light sources are positioned along forward and downwardly facing faces of the stanchion and of the arm, respectively. The faces of the stanchion and the arm are each provided with surfaces of high light reflecting capability. The surfaces face outwardly from each other at an obtuse angle. The weight and length of the arm and the weight of the stand are such that the device will not tip even when the stand is empty and the arm is in its horizontal position. Shelves in the cabinet are provided for the storage of work tools and supplies which, when so stored make the unit more stable and less susceptible to accidental tipping.

The invention relates to a mobile universal shop light particularly suited for use in illuminating various aspects of motor vehicles and related machinery during maintenance and repair. The mobile shop light of this invention is comprised of a lower stand mounted on means to provide mobility. A lower stand bar is rigidly attached to the lower stand and extends upward from the lower stand in a direction perpendicular to the plane of the lower stand. An upper stand bar telescopes into the lower stand bar, so as to allow the upper end of the upper stand bar to be positioned at different heights. Means is to secure the upper stand bar in position relative to the lower stand bar. Attaching means connected to the upper end of the upper stand bar adjustably attaches to the upper stand bar and elongated light fixture containing illuminating means and power supply means. The attaching means allows the fixture to rotate about its longitudinal axis and to be positioned with its longitudinal axis perpendicular to the upper stand bar and at intermediate angles to the perpendicular.

A portable utility lamp has a rectangular frame provided with a plurality of wheels for movement across a floor surface. A plurality of vertically extensible posts are mounted on the frame and rotatably support a lamp housing. A pair of frictional clamping disks are forced into abutment by manually tightened clamping nuts to secure the rotatable housing in an adjusted position. The center of mass of the lamp housing is disposed on the longitudinal axis of the clamping bolts to provide a balanced weight distribution which allows adjustment of the lamp housing with a minimum of effort. The extensible posts each include a tubular stationary member having an extensible member received for sliding movement therein. A coil spring biases the extensible member upwardly. A retaining pin is receivable through one of a plurality of spaced apertures provided in the extensible member to retain the lamp housing at a selected elevation. The utility lamp is particularly adapted for illuminating the undercarriage of a vehicle raised on a garage lift, and for a variety of other diverse uses.

A flood light assembly for mounting on the roof or top of an emergency vehicle. The flood light assembly is fully retractable and extendable and capable of complete rotation. Further, all of the components are structured and proportioned in such a manner that they fold together into a very compact, nested configuration for storage on the roof or top of the vehicle.

SUMMARY OF THE INVENTION

A primary object of the present invention is to provide a mobile illumination device that will overcome the shortcomings of the prior art devices.

Another object is to provide a mobile illumination device that offers a person, such as a mechanic, a much improved high power, shadow free, hands free, fully adjustable, collapsible and portable lighting stand.

An additional object is to provide a mobile illumination device that can be utilized for under the hood automotive repairs, underneath a raised motor vehicle, at the side to illuminate brake and suspension areas and to illuminate the interior surfaces of the vehicle.

A further object is to provide a mobile illumination device that is simple and easy to use.

A still further object is to provide a mobile illumination device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 4 is an enlarged top perspective view as indicated by arrow 4 in FIG. 2 of a portion thereof.

FIG. 5 is an enlarged top perspective view as indicated by arrow 5 in FIG. 2.

FIG. 6 is an enlarged bottom perspective view taken in the direction of arrow 6 in FIG. 4.

FIG. 7 is a side view taken in the direction of arrow 7 in FIG. 4, with parts broken away and in section.

DETAILED DESCRIPTION OF THE PREFERRED EMBODIMENTS

Figure 1:
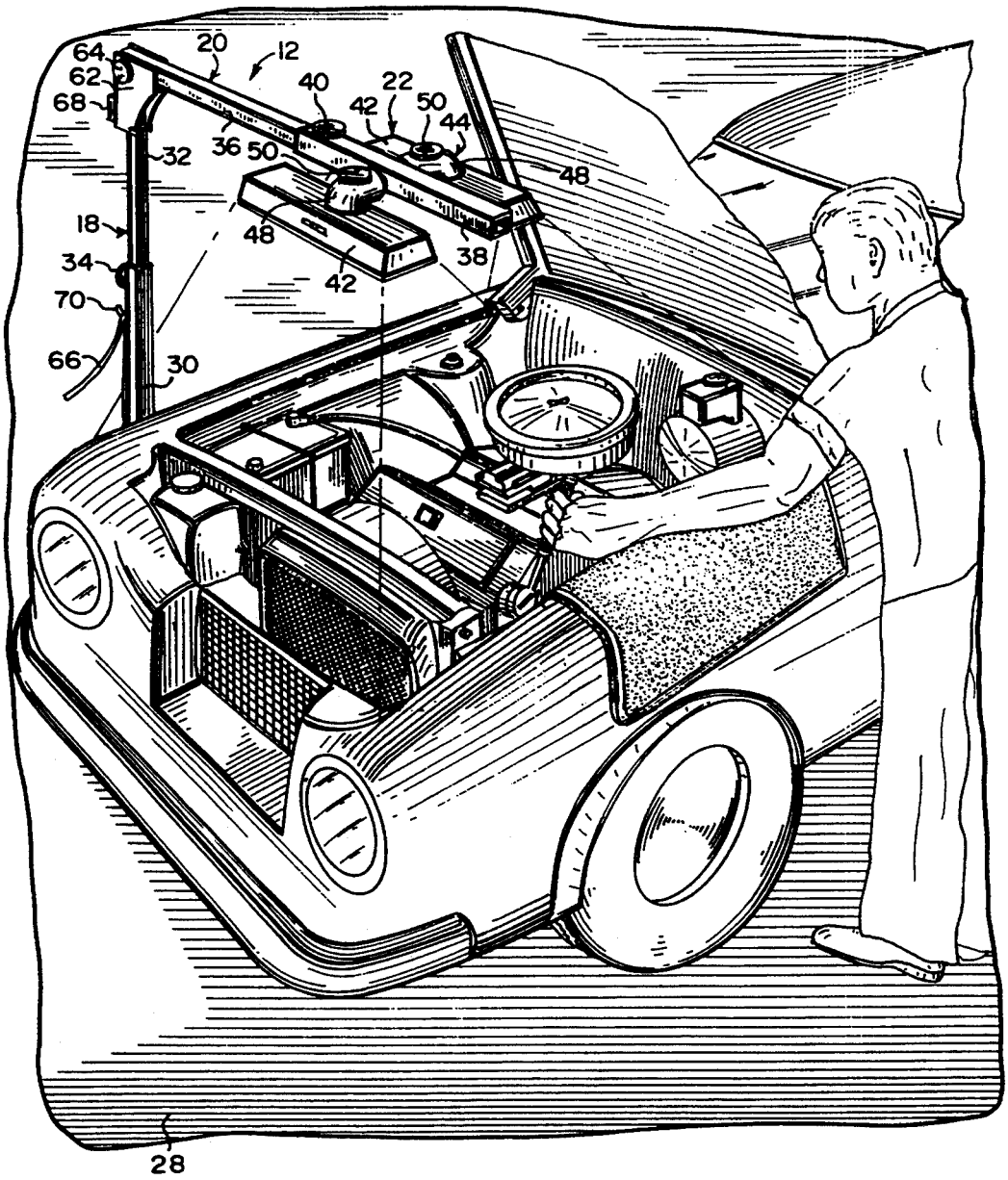
FIG. 1 is a top perspective view showing the instant invention in use, such as for under the hood automotive repairs.
Figure 2:
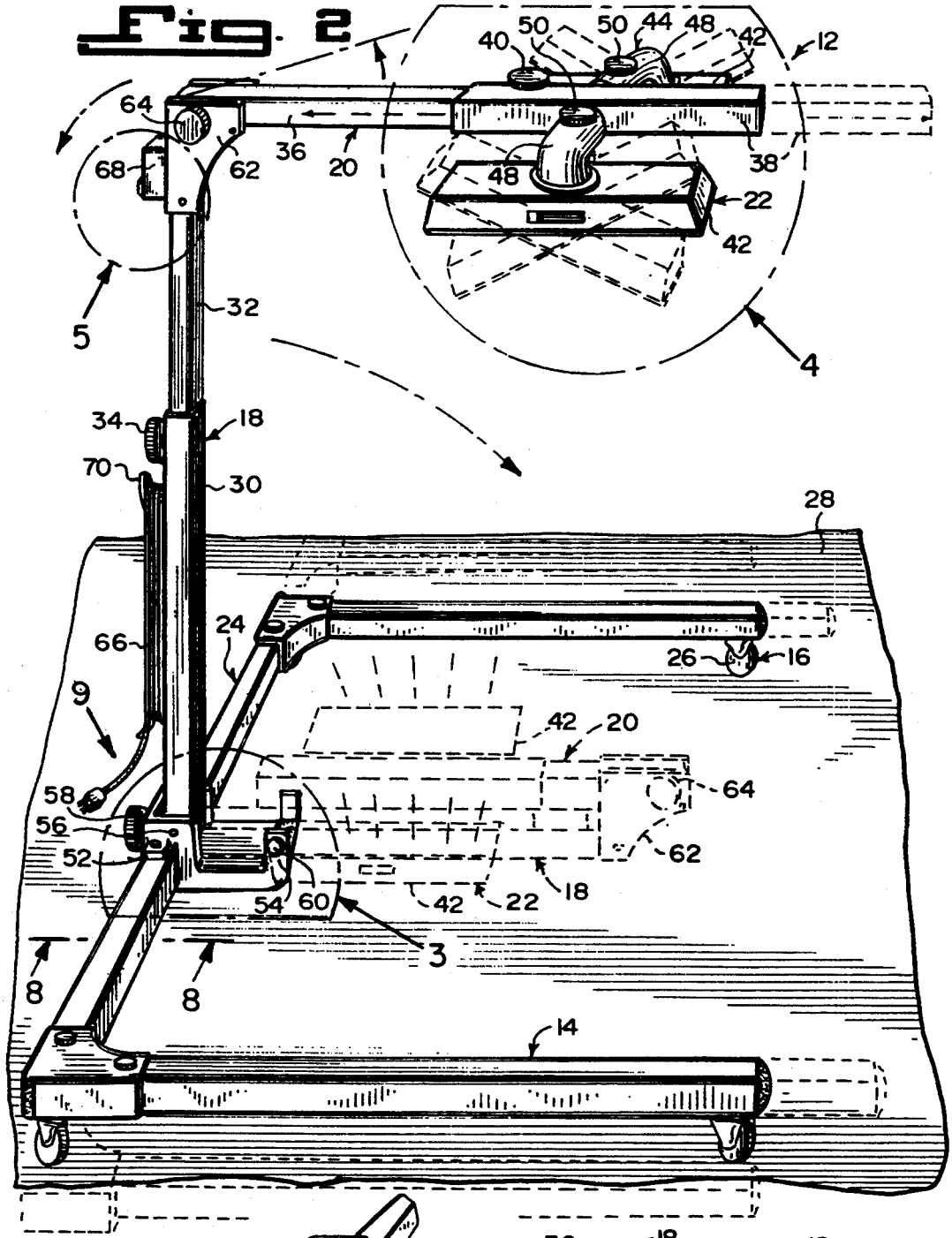
FIG. 2 is a top perspective view of the instant invention per se, showing in phantom, different adjustable positions for some of the parts thereof.
Figure 3:
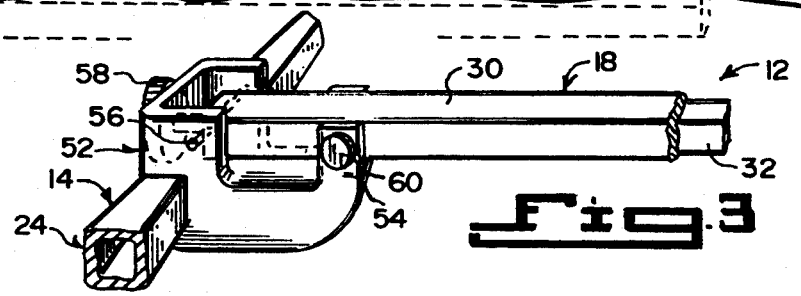
FIG. 3 is an enlarged top perspective view as indicated by arrow 3 in FIG. 2 of a portion thereof, showing the stanchion down in a horizontal position.

Turning now descriptively to the drawings, in which similar reference characters denote similar elements throughout the several views, FIGS. 1 through 10 illustrate a mobile illuminating device 12 comprising an adjustable base 14. Elements 16 are for providing mobility to the base 14. An adjustable stanchion 18 is on the base 14. An adjustable elongated arm 20 is on the stanchion 18, so as to overhang the base 14. An adjustable light source 22 is on the arm 20.

The adjustable base 14 is a C-shaped frame member 24. The mobility elements 16 are a plurality of casters 26 mounted to the underside of the frame member 24, so as to roll upon a flat horizontal surface 28.

The adjustable stanchion 18 includes a lower bar 30. An upper bar 32 telescopes into the lower bar 30, so as to allow the upper bar 32 to be positioned at different heights. A setscrew 34 is for securing the upper bar 32 in position relative to the lower bar 30.

The adjustable arm 20 contains an inner rod 36. An outer rod 38 which telescopes over the inner rod 36, so as to allow the outer rod 38 to be positioned at different widths. A setscrew 40 is for securing the outer rod 38 in position relative to the inner rod 36.

The light source consists of a pair of halogen light fixtures 42. A structure 44 is for mounting in an adjustable manner the light fixtures 42 to the outer rod 38. The light fixtures 42 can be placed in different angular positions with respect to the outer rod 38.

The adjustable mounting structure 44 includes a pair of pipes 46, each affixed at one end perpendicular to an opposite side of the outer rod 38. A pair of hollow elbow sleeves 48 are provided, with each affixed at a first end to one of the light fixtures 42, so that a second end can fit over one pipe 46. A pair of setscrews 50 are for securing each elbow sleeve 48 to each the pipe 46 in any adjustable manner.

A lower bracket 52 has a U-shaped padded stop seat 54 affixed to the frame member 24. A pivot pin 56 is for attaching a bottom end of the lower bar 30 to the bracket 52. A first setscrew 58 is in the bracket 52, for maintaining the lower bar 30 in a vertical position. A second setscrew 60 is in the U-shaped padded stop seat 54 of the bracket 52, for maintaining the lower bar 30 in a horizontal position within the U-shaped padded stop seat 54 of the bracket 52.

An upper bracket 62 is affixed in a pivotable manner between a top end of the upper bar 32 of the stanchion 18 and a free end of the inner rod 36 of the arm 20. The arm 20 can be positioned at different overhang angles. A setscrew 64 is for maintaining the arm 20 in any of the different overhang angles.

An elongated electrical cord 66 extends from the light fixtures 42 through the arm 20 and through the stanchion 18. A dimmer control 68 mounted on the upper bar 32 and is connected to the electrical cord 66. A hanger 70 is mounted on the lower bar 30, so that the electrical cord 66 can be wrapped about the hanger 70 for storage.

Figures 8, 9, 10:
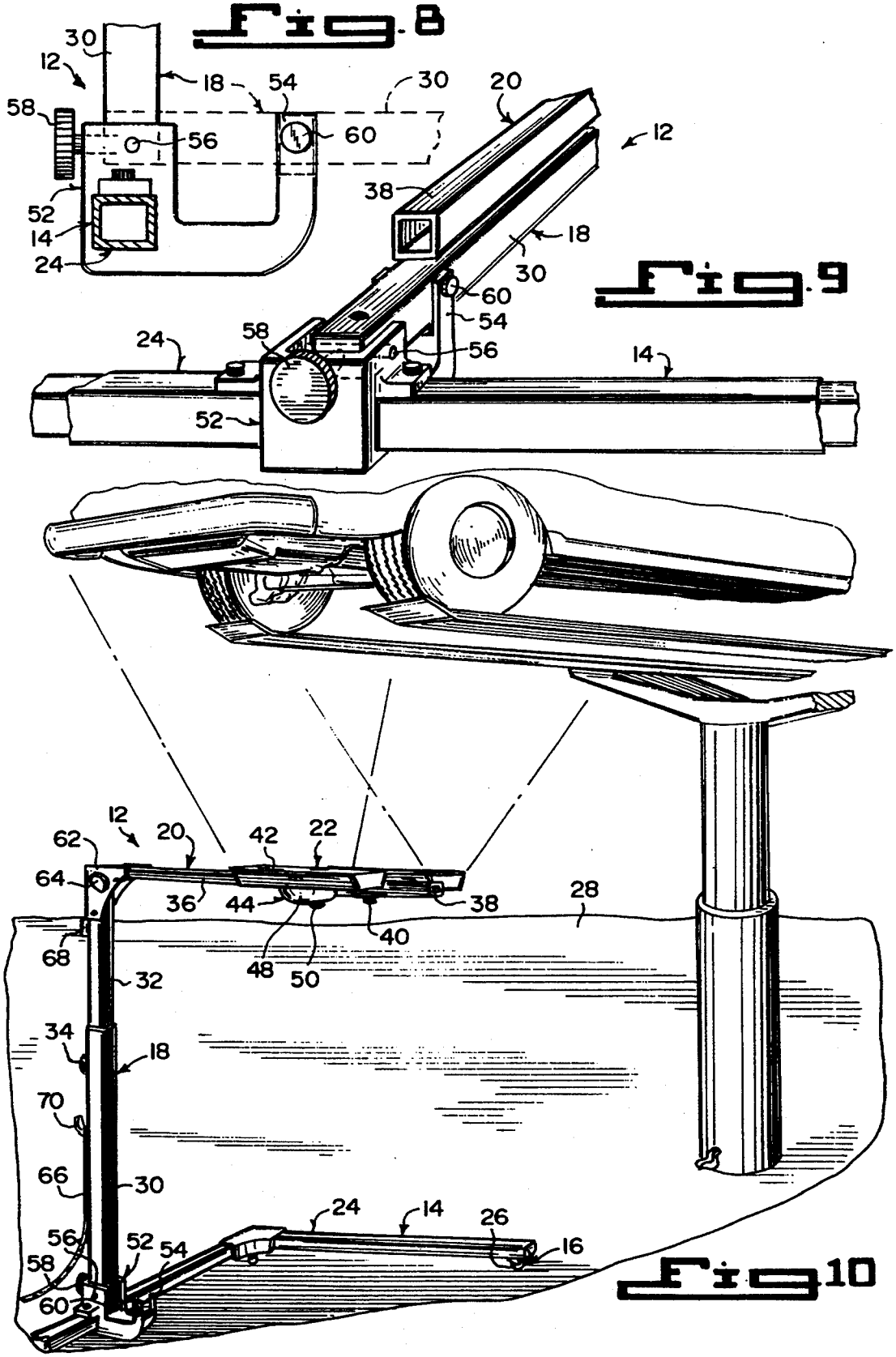
FIG. 8 is an enlarged cross sectional view taken along line 8—8 in FIG. 2.
FIG. 9 is a top perspective view as indicated by arrow 9 in FIG. 2 taken in the direction of arrow 9 with parts broken away.
FIG. 10 is a top perspective view with parts broken away, showing the instant invention in use, such as for use underneath a raised motor vehicle.

The mobile illumination device 12 can be used for under the hood automotive repairs, as shown in FIG. 1 and for use underneath a raised motor vehicle, as shown in FIG. 10. It can also be used in a fold down position, as shown in dotted lines in FIG. 2, to be placed under a motor vehicle held up by jack stands (not shown). The mobile illumination device 12 is adjustable in many positions, such as to the side of the vehicle to illuminate brake and suspension areas and into the interior surfaces of the vehicle.

The inner rod 36 and outer rod 38 of the adjustable elongated arm 20 can be manufactured out of two telescopic cylindrical pipe sections, to permit an even more angular adjustment capability for the halogen light fixtures 42 of the adjustable light source 22.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A mobile illuminating device comprising:

a) an adjustable base, said adjustable base being a C-shaped frame member;

b) means for providing mobility to said base, said mobility means including a plurality of casters mounted to the underside of said frame member, so as to roll upon a flat horizontal surface;

c) an adjustable stanchion on said base, said adjustable stanchion including a lower bar, an upper bar which telescopes into said lower bar, so as to allow said upper bar to be positioned at different heights, and a setscrew for securing said upper bar in position relative to said lower bar;

d) an adjustable elongated arm on said stanchion, so as to overhang said base, said adjustable arm including an inner rod, an outer rod which telescopes over said inner rod, so as to allow said outer rod to be positioned at different widths, and a setscrew for securing said outer rod in position relative to said inner rod; and e) an adjustable light source on said arm, said light source including a pair of halogen light fixtures, and means for mounting in an adjustable manner said light fixtures to said outer rod, so that said light fixtures can be placed in different angular positions with respect to said outer rod, said adjustable mounting means further including a pair of pipes, each affixed at one end perpendicular to an opposite side of said outer rod, a pair of hollow elbow sleeves, each affixed at a first end to one of said light fixtures, so that a second end can fit over one said pipe, and a pair of setscrews for securing each said elbow sleeves to each said pipe in any adjustable manner.

2. A mobile illumination device as recited in claim 1, further including:

a) a lower bracket having a U-shaped padded stop seat affixed to said frame member;

b) a pivot pin for attaching a bottom end of said lower bar to said bracket;

c) a first setscrew in said bracket for maintaining said lower bar in a vertical position; and d) a second setscrew in said U-shaped padded stop seat of said bracket for maintaining said lower bar in a horizontal position within said U-shaped padded stop seat of said bracket.

3. A mobile illumination device as recited in claim 2, further including:

a) an upper bracket affixed in a pivotable manner between a top end of said upper bar of said stanchion and a free end of said inner rod of said arm, so that said arm can be positioned at different overhang angles; and b) a setscrew for maintaining said arm in any of the different overhang angles.

4. A mobile illumination device as recited in claim 3, further including:

a) an elongated electrical cord extending from said light fixtures through said arm and through said stanchion;

b) a dimmer control mounted on said upper bar and connected to said electrical cord; and c) a hanger mounted on said lower bar, so that said electrical cord can be wrapped about said hanger for storage.

* * * * *